US006073418A

United States Patent [19]

Carroll

[11] Patent Number: 6,073,418

[45] Date of Patent: Jun. 13, 2000

[54] WEATHER RESISTANT CHIMNEY CAP SYSTEM

[76] Inventor: Dana M. Carroll, P.O. Box 840, Tremont, Ill. 61658

[21] Appl. No.: 09/229,097

[22] Filed: Jan. 13, 1999

[51] Int. Cl.[7] ..... E04G 21/00; E04G 15/06; E04H 12/28; E04D 13/14

[52] U.S. Cl. ..... 52/746.11; 52/58; 52/60; 52/219; 52/244; 285/43

[58] Field of Search ..... 52/50–62, 219, 52/244, 245, 746.11, 746.1, 301; 285/42, 43

[56] References Cited

U.S. PATENT DOCUMENTS

| | | | |
|---|---|---|---|
| 490,536 | 1/1893 | Boston . | |
| 2,956,495 | 10/1960 | Sublette . | |
| 3,089,521 | 5/1963 | Paiement . | |
| 3,363,369 | 1/1968 | Miller . | |
| 4,512,119 | 4/1985 | Willoughby | 52/58 |
| 4,970,837 | 11/1990 | Fogelstrom | 52/244 |
| 5,237,789 | 8/1993 | Thaler | 52/219 |
| 5,381,632 | 1/1995 | Damron | 52/58 |
| 5,706,610 | 1/1998 | Mayle | 62/60 |

*Primary Examiner*—Carl D. Friedman
*Assistant Examiner*—Yvonne M. Horton

[57] ABSTRACT

A unitary impervious boot member which includes a lip portion at the bottom thereof, which is fitted in substantial close tolerance around a chimney's flu tile. The lip portion of the member is sealed to the base of the upwardly extending flu tile by elastical pressure and optionally with adhesive such as silicone. The tightly fitted unitary impervious boot member is received and counterflashed by horizontal impervious member which substantially covers the entire horizontal surface of the sloped inner chimney structure before the cap is installed; and is sealed thereto by the gravitational pressure of the subsequently installed chimney cap and optionally with an adhesive such as silicone. Breathable weep lines are placed on top of the counterflashed horizontal impervious member to provide an exit for any trace moisture that may have penetrated the chimney cap.

8 Claims, 11 Drawing Sheets

WEATHER RESISTANT CHIMNEY CAP SYSTEM

BACKGROUND OF THE INVENTION

1. Field of the Invention

The present invention relates to an impervious boot member which is utilized in the process (along with other components) of creating a weather resistant seal at the flu and chimny cap portion of a typical masonry chimney.

2. Description of the Prior Art

It is well known in the building industry that chimney structures must constructed in a manner which provides protection to the adjoining building structure as well as chimney's inner structure from the outside weather elements. It is also well known within the industry for a mason to employ varying combinations of flashings, caps, and dampers in an attempt to provide the customer with a long-lasting weather tight seal upon and around the flu and chimney cap areas. Existing techniques as they apply to masonry chimneys have historically been met with limited long-term success due to the constant expansion/contraction process of a heated/cooled flu tile against a rigid concrete or mortar chimney cap; and, as a result of this constant freeze/thaw cycle, hairline cracks ultimately develop in and around the chimney and chimney cap areas. As the small hairline cracks develop they provide easy access for moisture penetration above the natural absorption rate of porous cement and mortar materials. Combine the increased moisture penetration with constant ongoing freeze/thaw cycles and larger cracks in the chimney and chimney cap eventually result. Larger and more frequent cracks lead to even more water penetration thereby leading to increased chimney structural decay, and so on. Usually after several years of this continuing freeze/thaw cycle, the chimney and chimney cap portion begin to deteriorate and crumble from the inside out.

History shows that the signs of decay and deterioration (since they usually originate from the inside of the chimney) are usually not detected until the chimney and chimney cap have reached the point of requiring a major renovation which most often includes a complete tear-down and rebuilding of the exposed chimney structure. Of course such major renovation is very costly to the owner of the chimney.

Applicant is unaware of any prior art which teaches the a process for creating a weather tight barrier around the flu and chimney cap areas, used in the construction of chimneys to promote a weather resistant seal in relationship to the

SUMMARY OF THE INVENTION

It is therefore a feature of the present invention to provide a long lasting weather tight seal for masonry chimney caps and the adjoining flu(s) which substantially overcomes all of the above-mentioned shortcomings known with in th e masonry profession.

A feature o f the present invention is to provide a impervious boot member which substantially surrounds the upwardly extended chimney flu(s) thereby creating a long-lasting moisture barrier between the flu(s) and the chimney cap.

According to the above features, from a broad aspect, there is provided a method of creating a weather resistant flu/chimney cap seal which is as follows: starting at the point directly before the chimney cap is installed upon the inner chimney structure, the horizontal impervious member is sealed (optionally) to the horizontal chimney surface with an adequately sized aperture which allows the chimney flu to extend upwardly through the horizontal impervious member. Installation of the horizontal impervious member also establishes a flashing portion around the lower outside portion of the flu. Said horizontal impervious member is optionally sealed to the horizontal chimney surface with adhesive and further held in place by the gravitational force of the subsequently installed chimney cap. Weep lines are then placed upon the horizontal impervious member to allow the expelling of trace moisture which penetrates the subsequently installed chimney cap. The concrete or mortar based chimney cap is then installed and allowed to cure. The cured chimney cap is then coated with one or more layers of a water resistant paint or sealant. This process is explained in more detail in the Description of Preferred Embodiments.

These and other features and objects will be seen from the following specifications and claims in conjunction with the appended drawings.

It will be understood that the above drawings illustrate merely a preferred embodiment of the invention and the steps of the present method and that other embodiments and steps are contemplated within the scope of the claims hereafter set forth.

DESCRIPTION OF THE PREFERRED EMBODIMENTS

Figure 1:
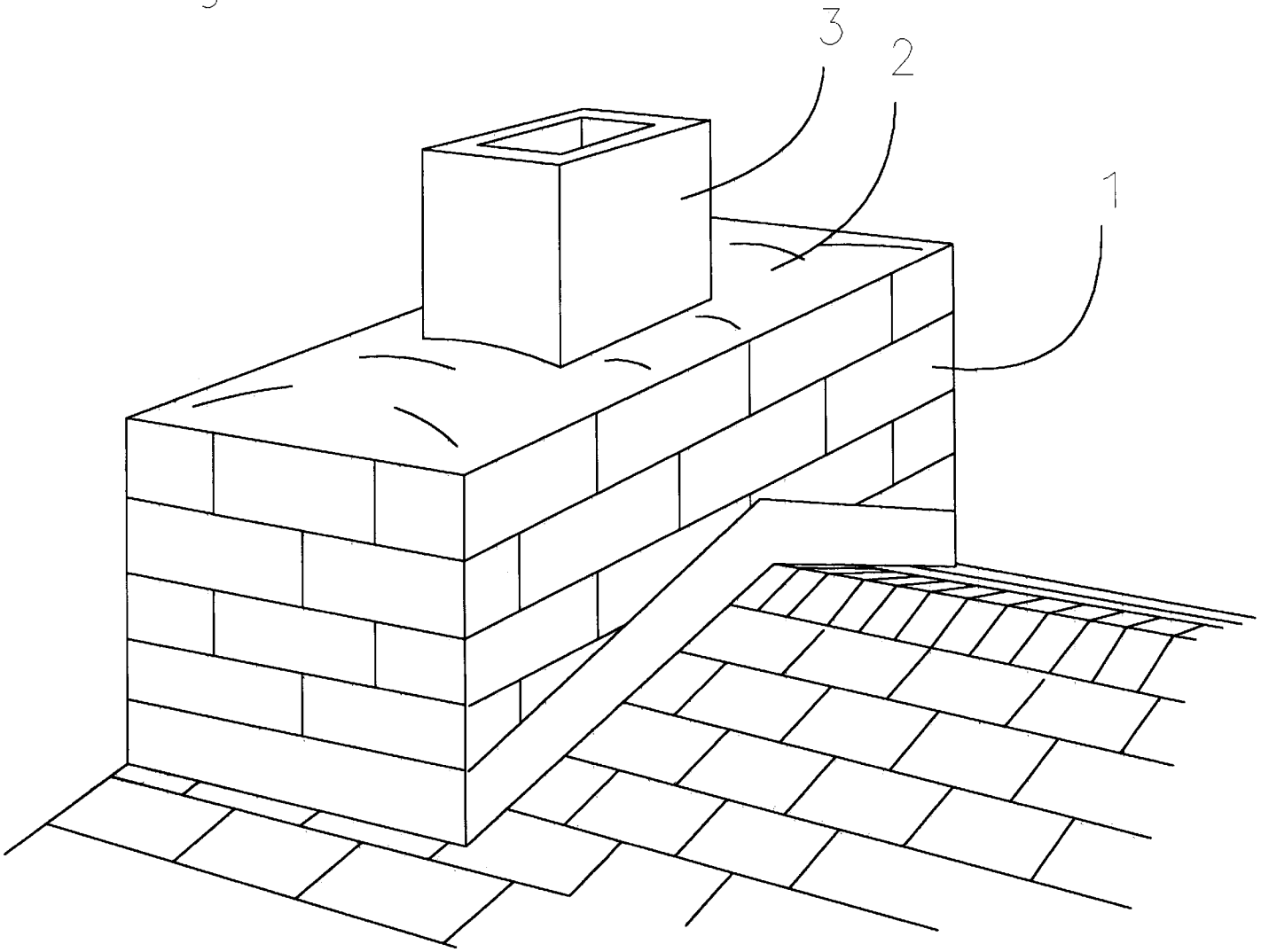
FIG. 1 is an isometric view of the bare chimney structure before installation of the Weather Resistant Chimney Cap System commences.
Figure 2:
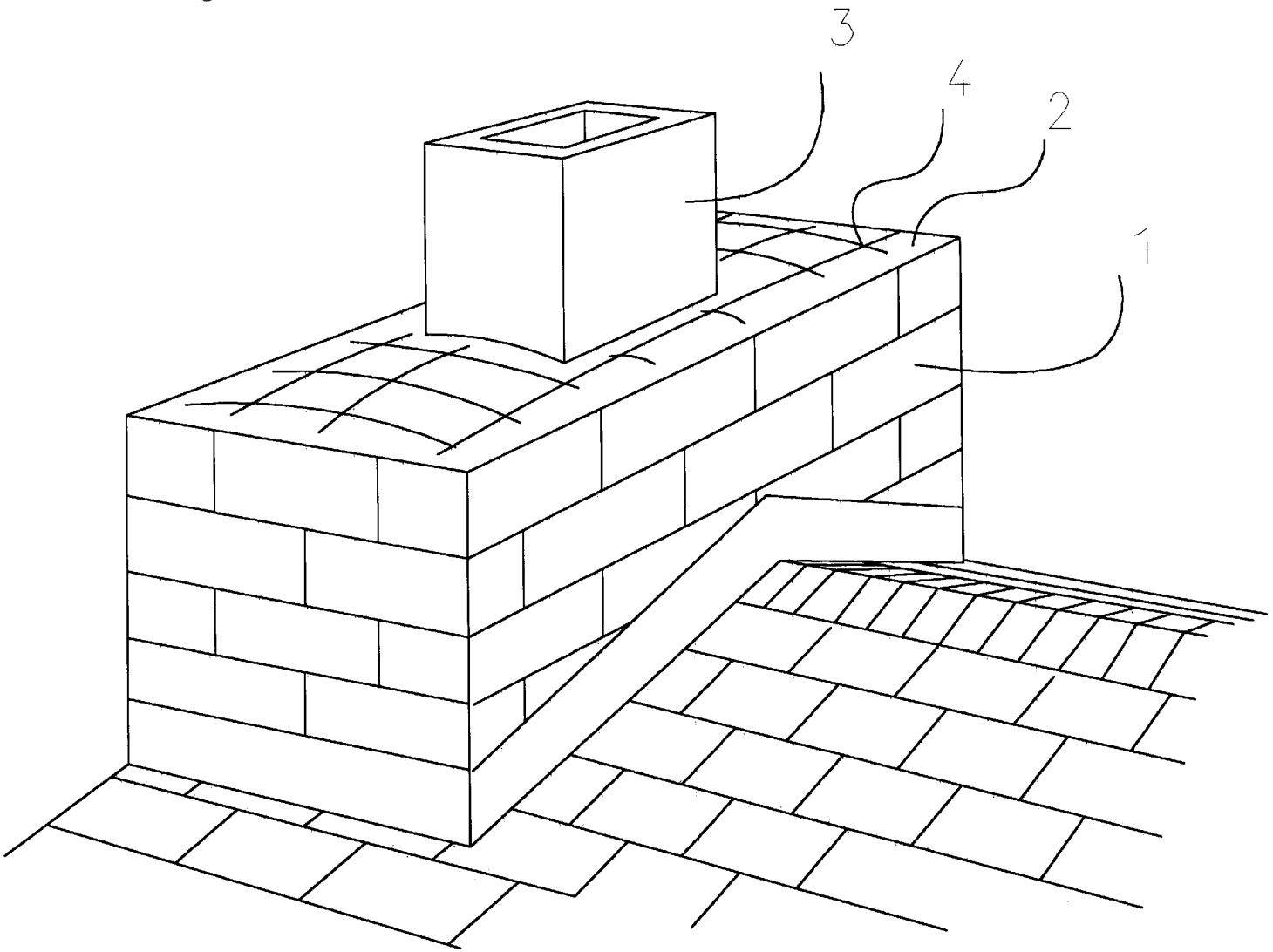
FIG. 2 is an isometric view of the bare chimney structure with sealant applied (optional step).
Figure 3:
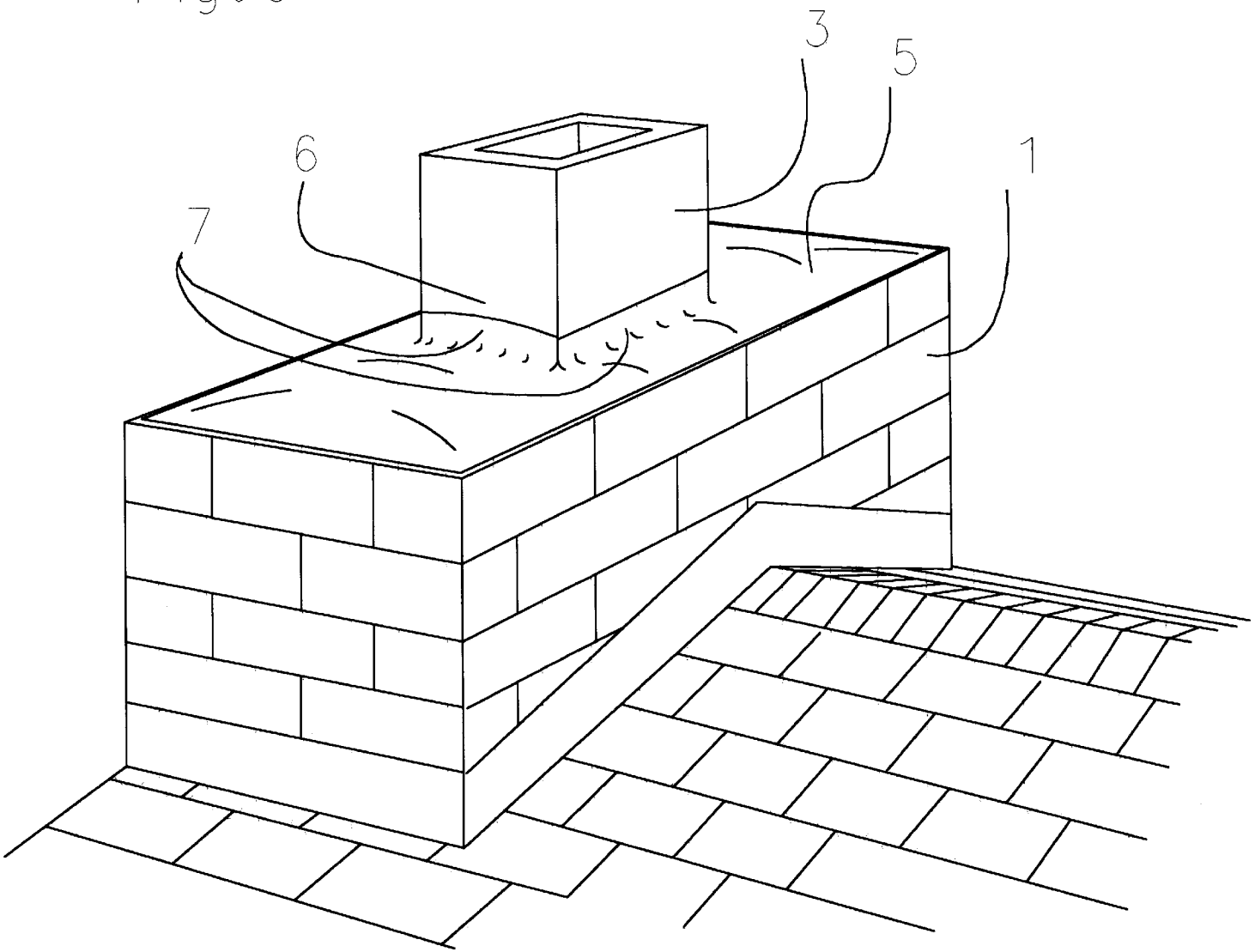
FIG. 3 is an isometric view of the chimney structure with the horizontal impervious member installed.
Figure 4:
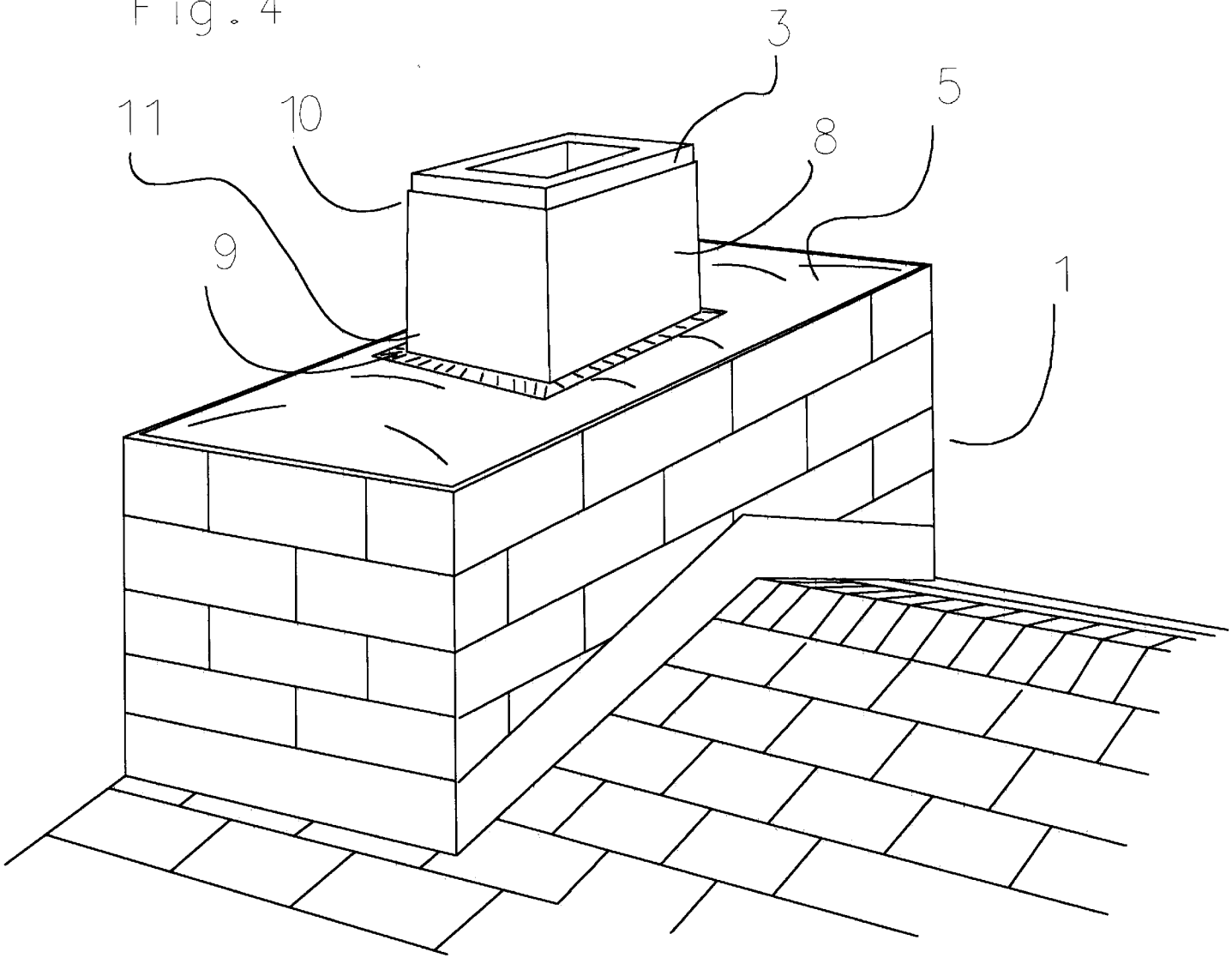
FIG. 4 is an isometric view of the chimney structure with the impervious boot member installed over the impervious horizontal member.
Figure 10:
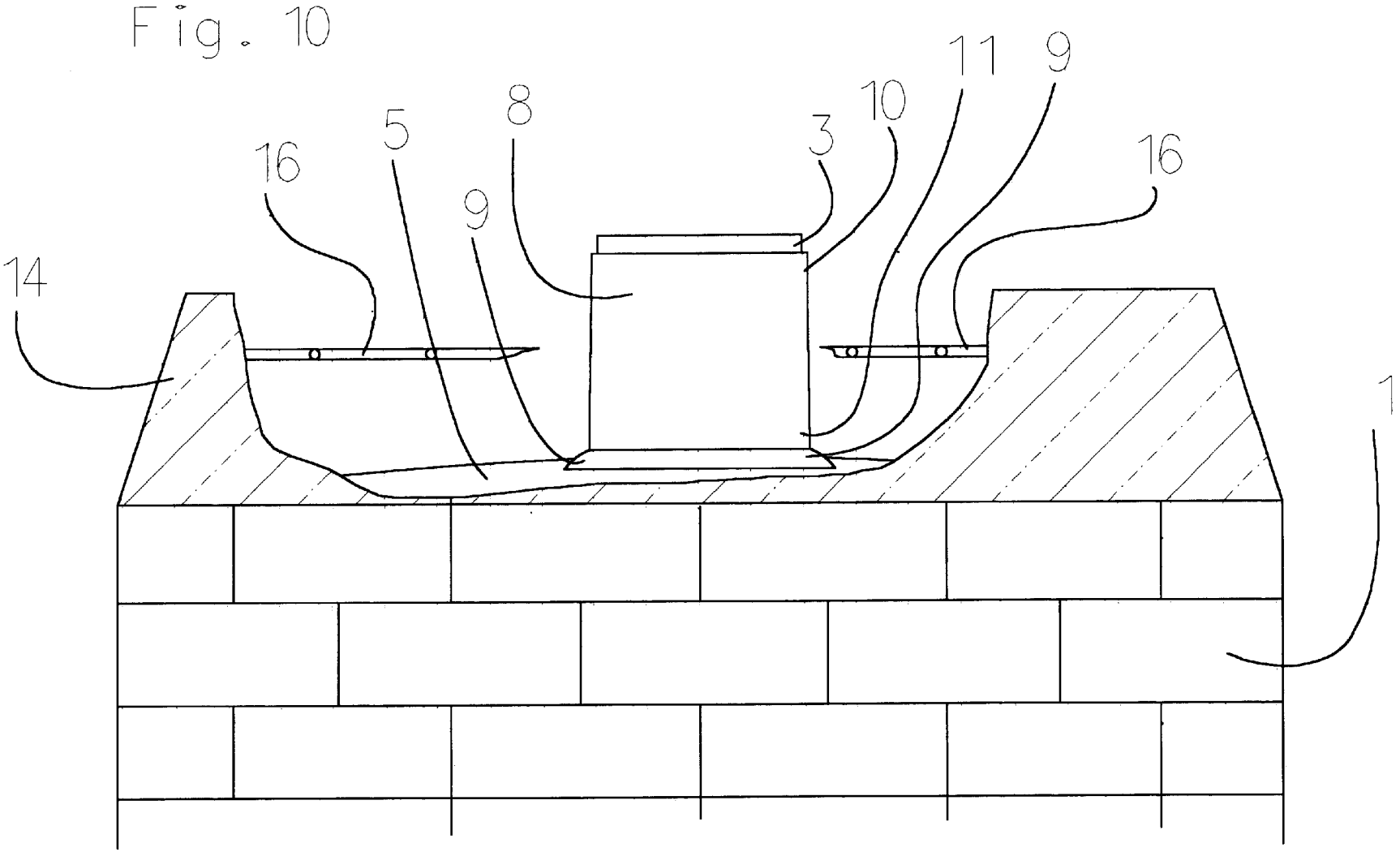
FIG. 10 is a cutaway view of the chimney cap which illustrates the placement of the impervious boot member in relation to the flu and chimney cap structure, and the rebar reinforcement for the chimney cap.
Figure 11:
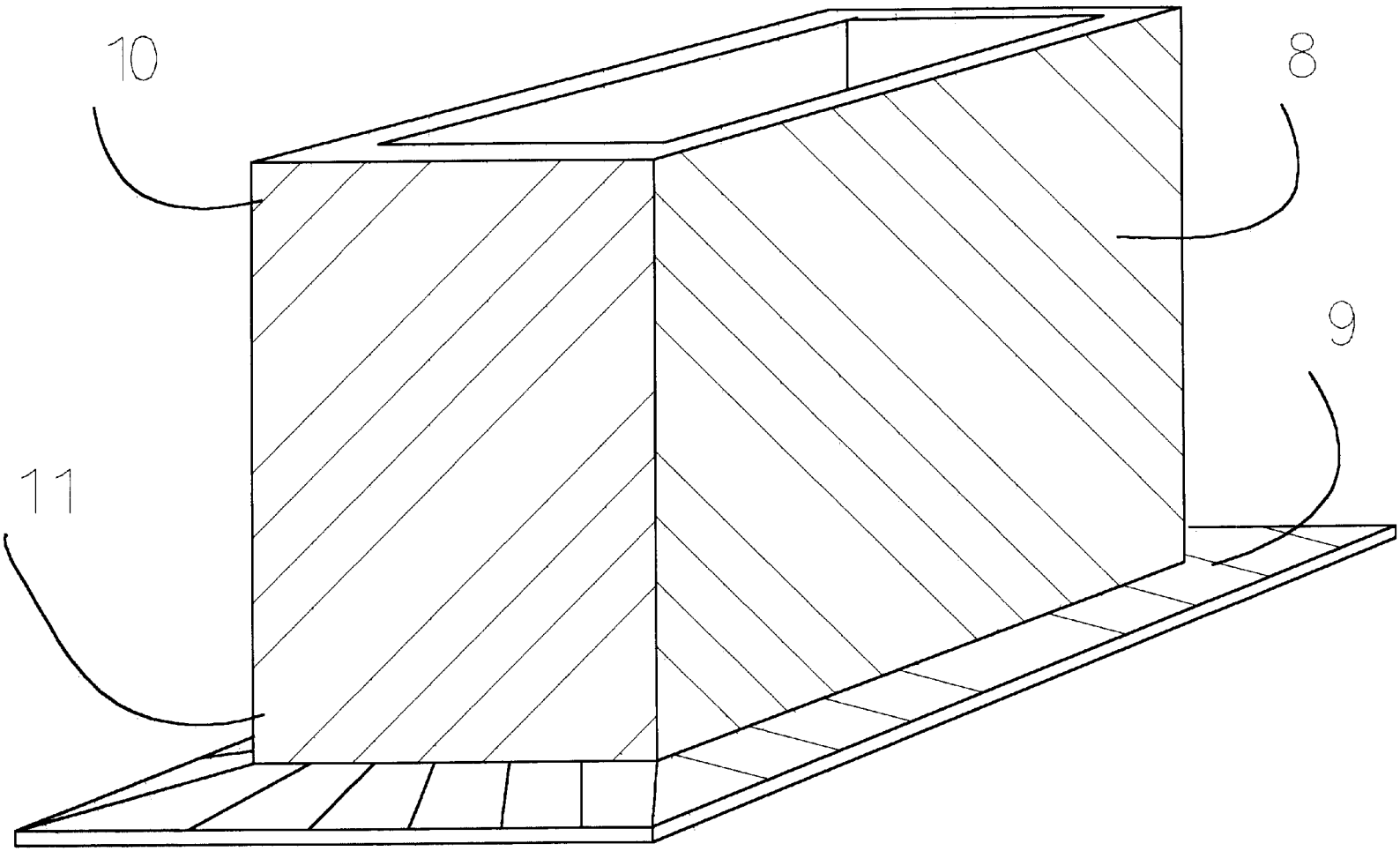
FIG. 11 is a isometric view of the impervious boot member.

Referring to FIG. 1, a typical masonry base chimney structure is shown as constructed upon a building structure. This figure shows the base chimney structure 1 finished to a point of completion precisely before a chimney cap would ordinarily be installed upon said base chimney structure 1. In this figure the chimney flu 3 is extending upwardly from the base chimney structure 1. Please note that the horizontal plane of the inner chimney structure 2 is not perfectly flat but instead finished at sloped angles on each side. It is this sloping of the inner chimney structure 2 that promotes the draining of moisture once other water resistant members are installed as explained herein. FIG. 2 shows the same base chimney structure 1 with sealant 4 (optionally) applied thereto, such as silicone, applied to the inner chimney structure 2 in a manner which assures complete sealing of the installed horizontal impervious member 5 as shown in FIG. 3. At this time a bead of sealant is also optionally placed around the bottom portion of the flu 3 between the flu 3 and the inner chimney structure 2. Now referring to FIG. 3, an aperture 6 is created in the horizontal impervious member 5 which allows the flu 3 to extend in close tolerance therethrough. By installing the horizontal impervious member 5 a counter-flashing 7 is created around the entire circumference of the flu 3 as a result of the close tolerance fitting of the horizontal impervious member 5 with the flu 3. At this time any air pockets are tamped from the horizontal impervious member 5 which also has the effect of promoting the uniform spreading of the underlying sealant 4 across the surface of the inner chimney structure 2 and squeezes any excess sealant 4 to the edges of the horizontal impervious member 5. The excess sealant 4 is then wiped from the edges. FIG. 4 is demonstrative of the impervious boot member 8 as installed upon the flu 3. A slurry of sealant is optionally applied to the remaining portion of the exposed flu 3 as well as portion of the horizontal impervious member 5 which will be covered by the lip portion 9. The sealant 4 as applied to the aforementioned surfaces creates a bond and a weather tight seal between the inner surface of the impervious boot member 8 to the outer surface of the flu 3. The impervious boot member 8 incorporates therein a lip portion 9 which acts as flashing over the horizontal counter-flashing 7. The impervious boot member 8 contains a slight taper which starts at the bottom of the impervious boot member 11 and extends to the top of the impervious boot member 10. This taper is necessary in order to necessitate the proper and expedient fitting of the impervious boot member 8 upon the flu 3 by reducing friction between the impervious boot member 8 and the flu 3 during installation, and by allowing space at the bottom of the impervious boot member 11 to receive the horizontal counter-flashing, 7 in a manner which allows the lip portion 9 to seat and seal completely upon the horizontal impervious member 5. Also see FIG. 11 for a larger detailed view of the impervious boot member 8. The cutaway side view of FIG. 10 shows the relationship of the installed impervious boot member 8 upon the flu 3 and the horizontal impervious member 5.

Figure 5:
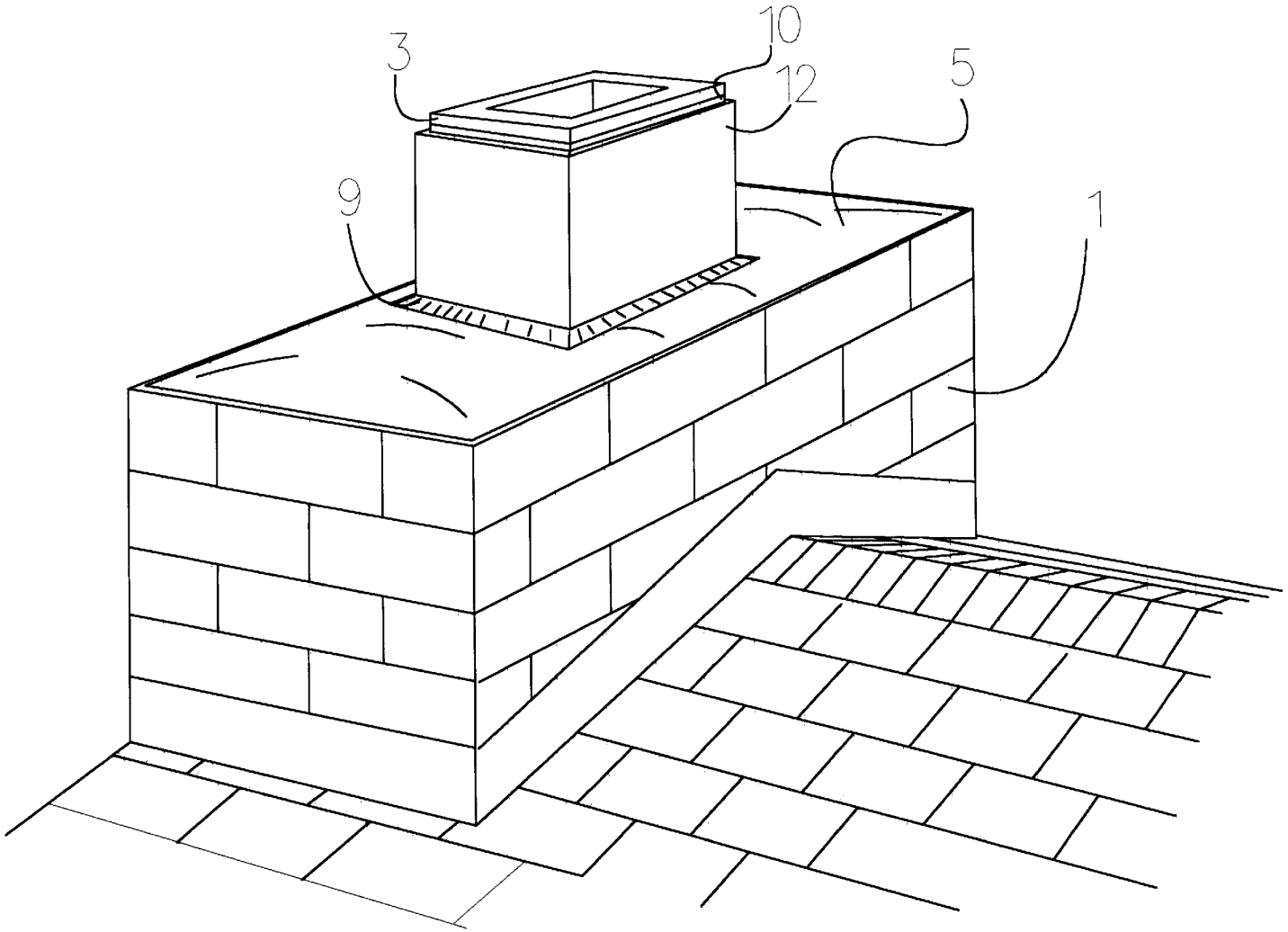
FIG. 5 is an isometric view of the chimney structure with joint expansion material applied around the circumference of the impervious boot member.

FIG. 5 shows expansion material 12 such as that which is typically used in the masonry trade where a concrete or masonry member needs space to expand and contract upon or against another stationary member. The expansion material 12 is fitted around the impervious boot member 8 and held in place by tape, rope, adhesive or other suitable securing method. The top of the expansion material 12 should extend upward farther than the top of the chimney cap 14 (see FIGS. 7, 8, 9 and 10). This excessive upward extension allows the portion of the flu 3 (as surrounded by the expansion material 12) and the portion of the chimney cap 14 which are in contact with each other to be protected from cracking and other deterioration caused by repeated expansion/contraction from ongoing freeze/thaw cycles.

Figure 6:
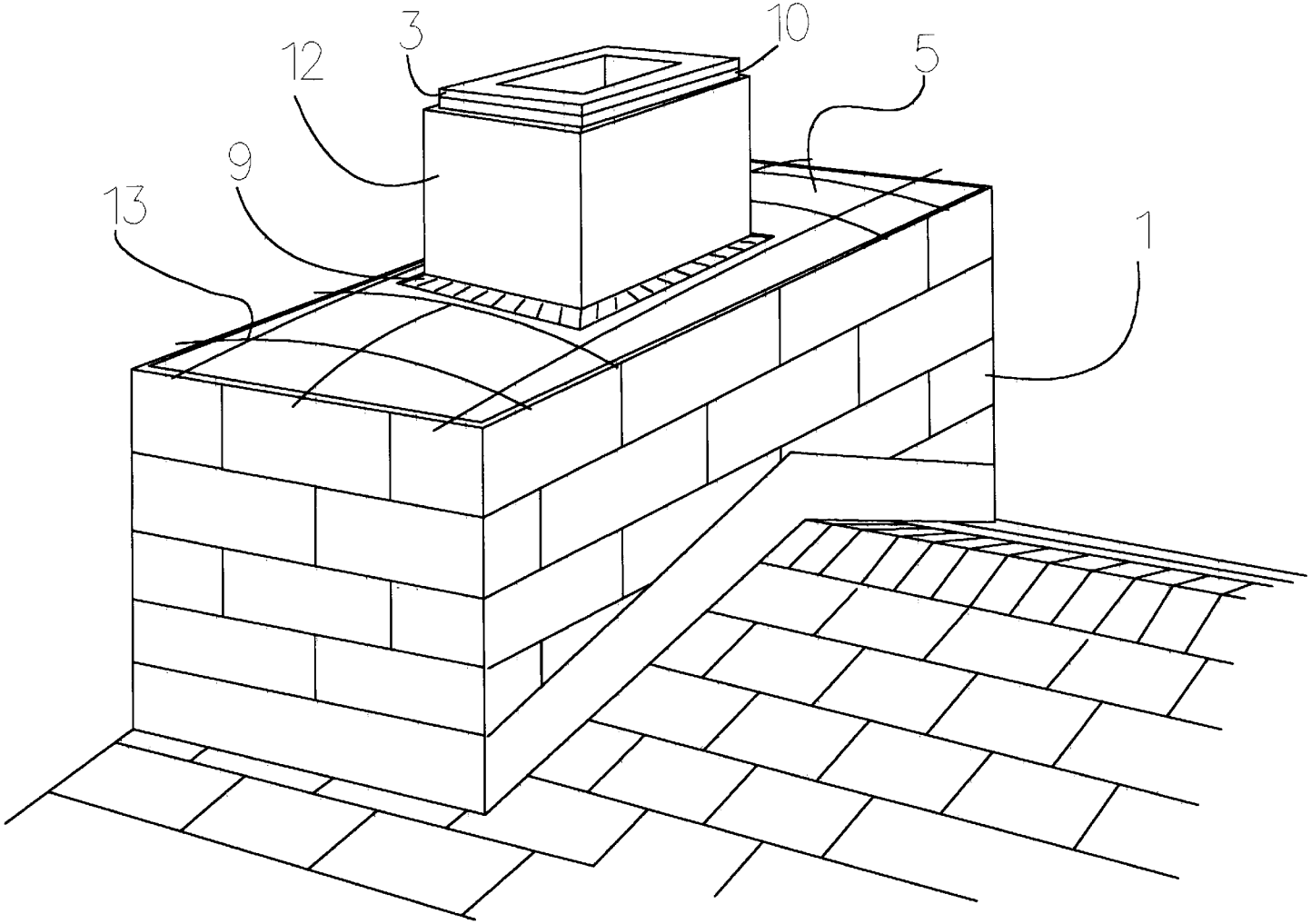
FIG. 6 is an isometric view of the chimney structure with the weep lines placed over the horizontal impervious member.
Figure 7:
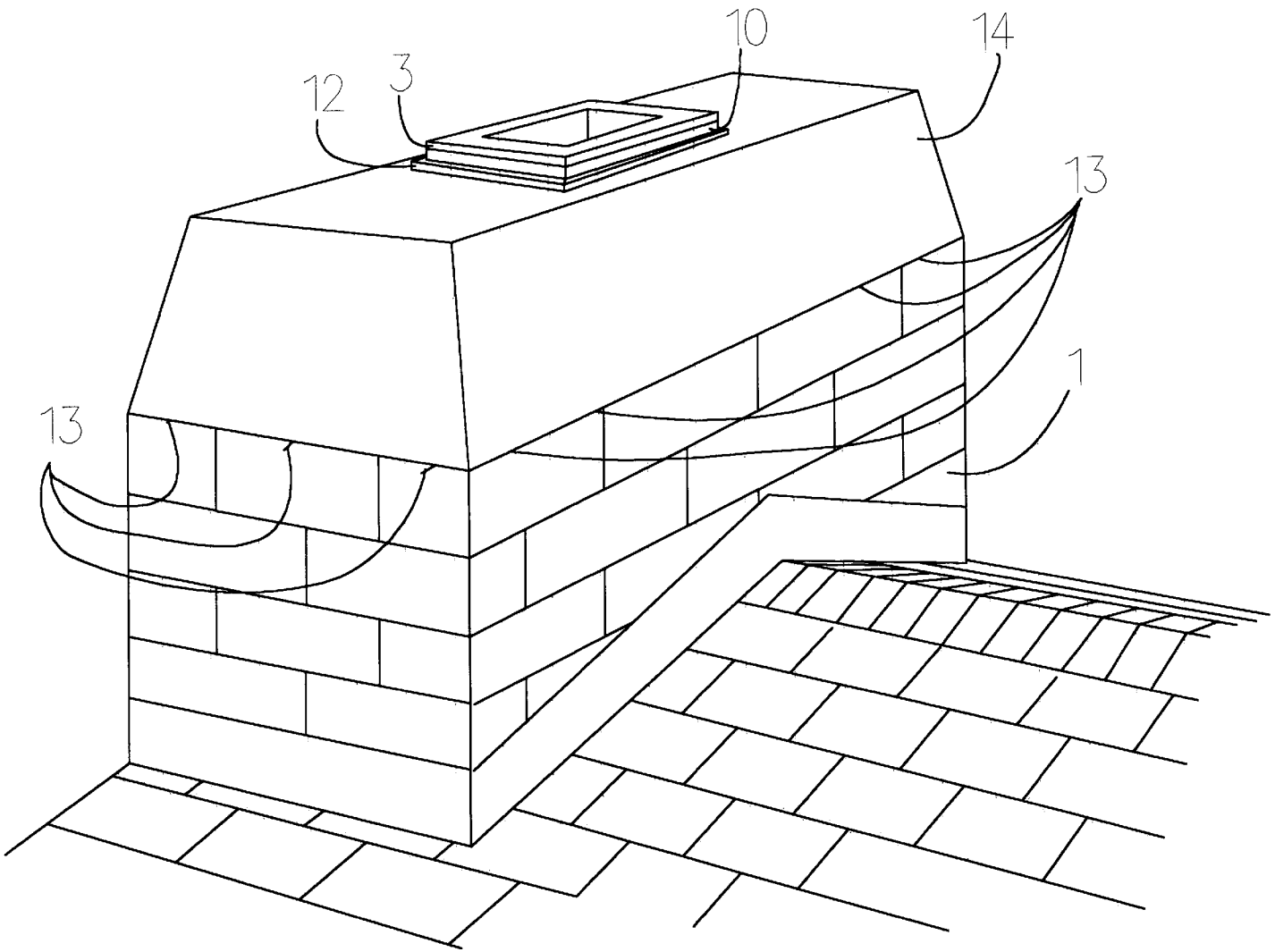
FIG. 7 is an isometric view of the chimney structure after the chimney cap has been installed.

FIG. 6 shows a grid of weep rope 13 (constructed of cotton or other suitable draining material) which is placed over the horizontal impervious member 5 in a manner which uses the gravitational forces created by the sloped surfaces of the inner chimney structure 2 to drain any trace moisture which enters the chimney cap 14, the horizontal impervious member 5, or the impervious boot member 8. FIG. 7 shows the chimney cap 14 as installed upon the base chimney structure 1. The chimney cap 14 contains at least one rebar grid 16 to act as reinforcement as illustrated in FIG. 10. FIG. 7 shows the ends of the weep rope 13 as well as the portion of the expansion material 12 which extends upward beyond the upper surface of the chimney cap 14.

Figure 8:
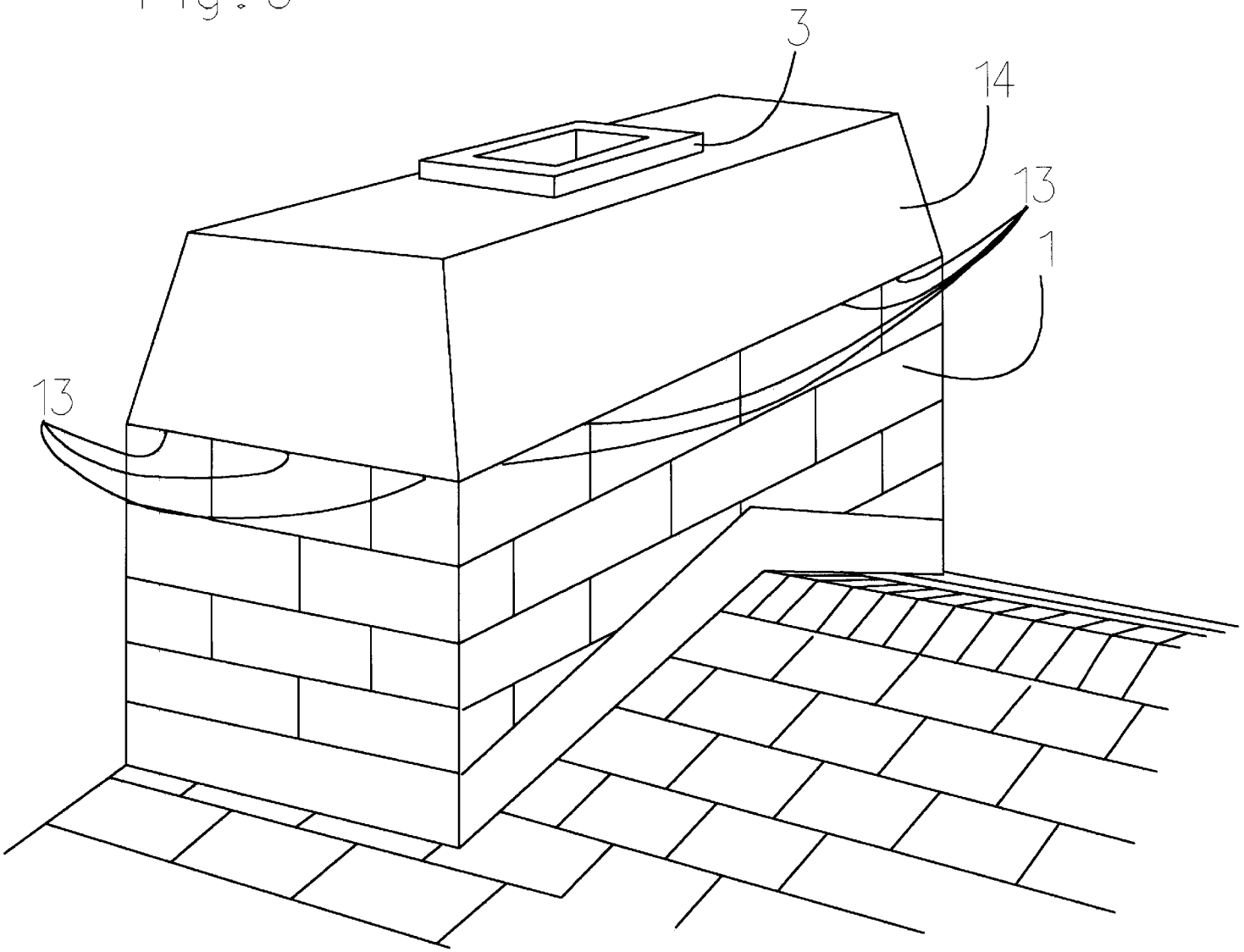
FIG. 8 is an isometric view of the chimney structure after the chimney cap has been installed, the excess joint expansion material and the excess impervious boot member material (upper portion) have been removed, and the weep lines have been trimmed flush with the chimney structure.

FIG. 8 shows the chimney cap 14 after the excess portions of the expansion material 12 and the top portion of the impervious boot member 10 (now both invisible in this figure) have been trimmed to a level slightly below the upper surface of the chimney cap 14 whereafter a bead of sealant is optionally applied between the impervious boot member 8 and the chimney cap 14 in a beveled offset manner away from the flu 3 thereby creating a run-off angle and a first line barrier to prohibit moisture from entering the flu 3, the impervious boot member 8, or the chimney cap 14 area which adjoins the flu (as surrounded by said expansion material 12). Although not necessary as a part of this process, at least one coat of a water resistant sealant may be applied to the entire chimney cap 14 area which acts as a barrier against the entry of moisture into the chimney cap 14.

Figure 9:
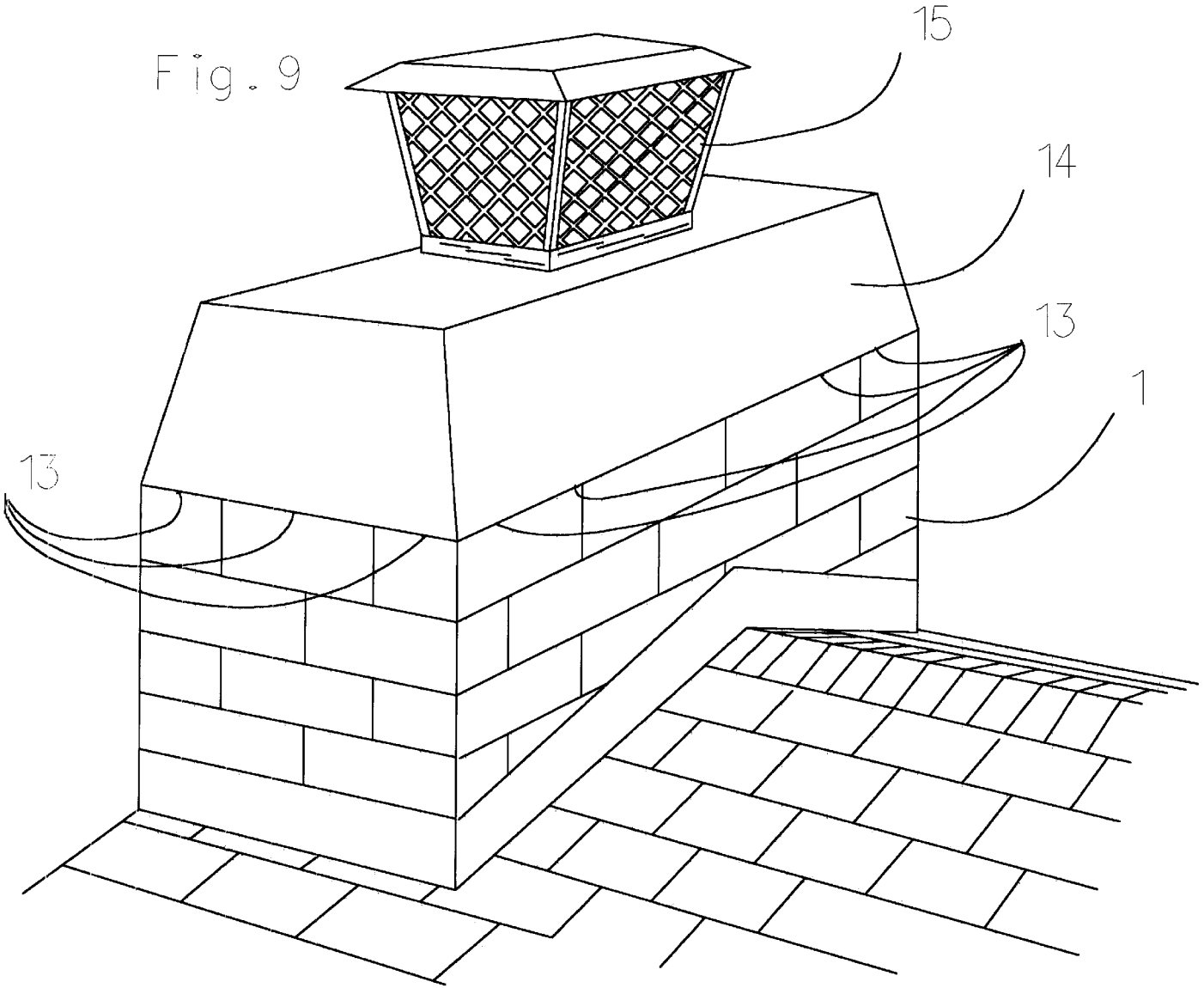
FIG. 9 is an isometric view of the chimney structure after the flu cap has been installed.

Although not necessary as a part of this process, FIG. 9 shows a flu cap 15 installed upon the exposed portion of the flu 3 thereby further acting as a barrier against moisture and pests.

One acceptable material in which the horizontal impervious member 5 and the impervious boot member 8 may be constructed of is a EPDM material which is a rubbery membrane that is 0.045 inches in thickness and manufactured by the Firestone Corporation. Other suitable impervious materials may also be used in the construction of said impervious members as along as proper seals are attained about the flu 3 and chimney cap 14 areas as indicate herein, and as long as the construction material does not dry and/or crack after installation thereof due to the ongoing freeze/thaw cycles.

The embodiments of the present invention described herein are intended to be illustrative only, and not restrictive. The scope of the present invention and the boundaries thereof are intended to be as defined by the appended claims, and all embodiments, processes, and methods contained therein are intended to be embraced thereby. The invention accordingly may be embodied in other specific forms without departing from the spirit or essential characteristics thereof. All changes which come within the meaning and range of equivalency of the appended claims are intended to be embraced therein.

I claim:

1. A method for installing a weather proof system which inhibits structural decay of a masonry chimney, said method comprising:

a) forming an aperture within a horizontal impervious member which allows the placement and fitting of said horizontal impervious member across the horizontal plane of a sloped inner chimney structure;

b) sizing an impervious boot member which is further comprised of an inner and outer surface and an upper and lower portion, in a manner which causes said inner surface to make close substantial contact with a flu when said impervious boot member is slid over said flu in the direction of said horizontal impervious member, and such movement shall continue until a lip portion of said impervious boot member is in substantial contact with said horizontal impervious member thereby creating a seal between the horizontal impervious member, the impervious boot member, and the sloped inner chimney structure;

c) spacing weep rope across the horizontal plane of said horizontal impervious member in a manner which promotes the drainage of any trace of moisture which reaches said weep rope by penetration of a chimney cap;

d) displacing expansion material about the outer surface of said impervious boot member in a manner which substantially covers said outer surface;

e) constructing said chimney cap upon said horizontal impervious member.

2. The method of claim 1, wherein the sealing of said impervious boot member, said horizontal impervious member, and said sloped inner chimney structure is further effected by applying sealant between the flu and the sloped inner chimney structure before the impervious boot member is installed upon said flu, in order to prevent moisture from penetrating the area between the flu and the sloped inner chimney structure.

3. The method of claim 1, wherein the sealing of said impervious boot member, said horizontal impervious member, and said sloped inner chimney structure is further effected by applying sealant upon said sloped inner chimney structure before said horizontal impervious member is installed thereupon.

4. The method of claim 1, wherein the sealing of said impervious boot member, said horizontal impervious member, and said sloped inner chimney structure is further effected by applying sealant to the flu and the lip portion before said impervious boot member is installed upon said flu in order to prevent moisture from penetrating the area between the flu and the impervious boot member.

5. The method of claim 1, wherein the sealing of said impervious boot member, said horizontal impervious member, and said sloped inner chimney structure is further effected by applying sealant between the flu and the chimney cap in order to prevent moisture from penetrating the area between the flu and the chimney cap.

6. The method of claim 1, wherein the displacing of said expansion material further includes trimming said expansion material to a level slightly below the top of the constructed chimney cap.

7. The method of claim 1, wherein the installing of the weather proof system is further defined by installing a flu cap upon said flu.

8. The method of claim 1, wherein constructing the chimney cap includes applying one or more layers of water resistant paint or sealant thereupon.

* * * * *